US010537008B2

(12) United States Patent
Chu et al.

(10) Patent No.: US 10,537,008 B2
(45) Date of Patent: Jan. 14, 2020

(54) UNIVERSAL METHOD FOR DRIVING LEDS USING HIGH VOLTAGE

(71) Applicant: VastView Technology Inc., Hsinchu County (TW)

(72) Inventors: Hung-Chi Chu, Hsinchu County (TW); Yuhren Shen, Hsinchu County (TW)

(73) Assignee: VastView Technology Inc., Hsinchu County (TW)

( * ) Notice: Subject to any disclaimer, the term of this patent is extended or adjusted under 35 U.S.C. 154(b) by 314 days.

(21) Appl. No.: 15/638,381

(22) Filed: Jun. 30, 2017

(65) Prior Publication Data

US 2019/0008016 A1 Jan. 3, 2019

(51) Int. Cl.
*H05B 37/02* (2006.01)
*H05B 33/08* (2006.01)

(52) U.S. Cl.
CPC ..... *H05B 37/02* (2013.01); *H05B 33/083* (2013.01); *H05B 33/0803* (2013.01)

(58) Field of Classification Search
CPC ... H05B 33/0803; H05B 33/083; H05B 37/02
USPC ..... 315/185 R, 189–192
See application file for complete search history.

(56) References Cited

U.S. PATENT DOCUMENTS 8,847,501 B1 * 9/2014 Chu ..... H05B 33/083 315/122
9,794,992 B1 * 10/2017 Chu ..... H05B 33/0824
2009/0218960 A1 * 9/2009 Lyons ..... G01J 1/32 315/297
2011/0084619 A1 * 4/2011 Gray ..... H05B 33/0824 315/185 R
2019/0208594 A1 * 7/2019 Jozef ..... H05B 33/0824

* cited by examiner

*Primary Examiner* — Dedei K Hammond
*Assistant Examiner* — Amy X Yang
(74) *Attorney, Agent, or Firm* — Lin & Associates Intellectual Property, Inc.

(57) ABSTRACT

An apparatus for driving LEDs using high voltage includes two LED driving circuits and two switches controlled by a universal controller so as to connect the two LED driving circuits in two different configurations. Each LED driving circuit has an LED unit formed by a plurality of LED segments. Each LED segment has an associated bypass switch controlled by an LED controller to bypass or connect the LED segment in the LED unit. When an input voltage ranges from rectified 90 volt AC to rectified 140 volt AC, the two switches are controlled to connect the two LED driving circuits in parallel. When the input voltage ranges from rectified 180 volt AC to rectified 265 volt AC, the two switches are controlled to connect the LED segments of the LED unit in one LED driving circuit in series with the other LED driving circuit.

8 Claims, 10 Drawing Sheets

| | LED bypass switch-1 | LED bypass switch-2 | LED bypass switch-3 | LED bypass switch-4 |
|---|---|---|---|---|
| LED input voltage level-1 | OFF | ON | ON | ON |
| LED input voltage level-2 | ON | OFF | ON | ON |
| LED input voltage level-3 | OFF | OFF | ON | ON |
| LED input voltage level-4 | ON | ON | OFF | ON |
| LED input voltage level-5 | OFF | ON | OFF | ON |
| LED input voltage level-6 | ON | OFF | OFF | ON |
| LED input voltage level-7 | OFF | OFF | OFF | ON |
| LED input voltage level-8 | ON | ON | ON | OFF |
| LED input voltage level-9 | OFF | ON | ON | OFF |
| LED input voltage level-10 | ON | OFF | ON | OFF |
| LED input voltage level-11 | OFF | OFF | ON | OFF |
| LED input voltage level-12 | ON | ON | OFF | OFF |
| LED input voltage level-13 | OFF | ON | OFF | OFF |
| LED input voltage level-14 | ON | OFF | OFF | OFF |
| LED input voltage level-15 | OFF | OFF | OFF | OFF |

FIG. 6

UNIVERSAL METHOD FOR DRIVING LEDS USING HIGH VOLTAGE

CROSS-REFERENCE TO RELATED APPLICATION

This application is related to U.S. patent application Ser. No. 15/496,029, filed Apr. 25, 2017, which is incorporated herewith by reference.

BACKGROUND OF THE INVENTION

1. Field of the Invention

The present invention relates generally to light emitting diode (LED) based lighting apparatus, and more particularly to an apparatus and method for driving an LED based lighting apparatus using high input voltage.

2. Description of Related Arts

LEDs are semiconductor-based light sources often employed in low-power instrumentation and appliance applications for indication purposes in the past. The application of LEDs in various lighting units has also become more and more popular. For example, high brightness LEDs have been widely used for traffic lights, vehicle indicating lights, and braking lights. In recent years, because of the energy saving advantage, high voltage LED-based lighting apparatus have been developed and deployed to replace the conventional incandescent and fluorescent lamps.

An LED has an I-V characteristic curve similar to an ordinary diode. When the voltage applied to the LED is less than a forward voltage, only very small current flows through the LED. When the voltage exceeds the forward voltage, the current increases sharply. The output luminous intensity of an LED light is approximately proportional to the LED current for most operating values of the LED current except for the high current value. A typical driving device for an LED light is designed to provide a constant current for stabilizing light emitted from the LED and extending the life of the LED.

In order to increase the brightness of an LED light, a number of LEDs are usually connected in series to form an LED-based lighting string and a number of LED-based lighting strings may further be connected in series to form a lighting apparatus. The operating voltage required by each lighting string typically is related to the forward voltage of the LEDs in each lighting string, how many LEDs are employed for each of the lighting strings and how they are interconnected, and how the respective lighting strings are organized to receive power from a power source.

Accordingly, in many applications, some type of voltage conversion device is required in order to provide a generally lower operating voltage to one or more LED-based lighting strings from more commonly available higher power supply voltages. The need of a voltage conversion device reduces the efficiency, costs more and also makes it difficult to miniaturize an LED-based lighting device.

In order to increase the efficiency and miniaturize the LED-based lighting apparatus, many techniques have been developed for the apparatus to use operating voltages such as 110 volt AC or 220 volt AC without requiring a voltage conversion device. In general, the LEDs in the apparatus are divided into a number of LED segments that can be selectively turned on or off by associated switches or current sources, and a controller is used to control the switches or current sources as the operating AC voltage increases or decreases.

As more and more LED-based lighting apparatus are used in high brightness lighting equipment with high input voltage, there is a strong need to design methods and apparatus that can drive and connect the LED-based lighting strings intelligently and efficiently by using the readily available AC source from a wall power unit which provides a high voltage.

SUMMARY OF THE INVENTION

The present invention has been made to provide a method and apparatus that can efficiently drive an LED string with an AC voltage in different high voltage ranges such as from 90 volts to 140 volts or from 180 volts to 265 volts as its input voltage.

According to the present invention, the LED lighting apparatus comprises two LED driving circuits controlled by a universal controller. The universal controller controls two switches that can be turned on or off so as to connect the two LED driving circuits in two different configurations.

Each of the LED driving circuits comprises an LED unit having a plurality of LEDs divided into a plurality of LED segments with each LED segment having an associated bypass switch. Except for the first and last LED segments, each LED segment has a positive end and a negative end connected respectively to the negative end of its preceding LED segment and the positive end of its following LED segment. An LED controller controls each bypass switch to bypass or connect the associated LED in the LED unit. The LED unit is connected to a current source.

In the present invention, the associated bypass switch of each LED segment may be connected in two different schemes. In one scheme, one end of the bypass switch is connected to the negative end of the associated LED segment and the other end of the bypass switch is connected to a common node in the LED driving circuit. In the other scheme, the two ends of the bypass switch are connected respectively to the positive and negative ends of the associated LED segment.

In the first scheme, the current source connects the common node to the ground and the associated bypass switches may be turned on and off sequentially one by one as the input voltage applied to the LED unit increases, and then turned on and off sequentially one by one in a reverse order as the input voltage applied to the LED unit decreases. The associated bypass switches may also be all turned on initially and turned off sequentially one by one as the input voltage applied to the LED unit increases, and then turned on again sequentially one by one in a reverse order as the input voltage applied to the LED unit decreases while the bypass switch associated with the last LED segment is always turned on.

In the second scheme, the current source connects the negative end of the last LED segment to the ground. The associated bypass switches may be all turned on initially and turned off sequentially one by one as the input voltage applied to the LED unit increases, and then turned on again sequentially one by one in a reverse order as the input voltage applied to the LED unit decreases. In the second scheme, each associated bypass switch may also be selectively rather than sequentially turned on or off to result in an appropriate number of LEDs that can be conductive based on the voltage level as the input voltage applied to the LED unit changes.

A first switch connects the positive end of the first LED segment of the first LED driving circuit to the positive end of the first LED segment of the second LED driving circuit, and a second switch connects the negative end of the last LED segment of the first LED driving circuit to the positive end of the first LED segment of the second LED driving circuit. The input voltage is connected to the positive end of the first LED segment of the first LED driving circuit and the universal controller.

When the input voltage is in a range from rectified 90 volt AC to rectified 140 volt AC, the first switch is turned on and the second switch is turned off by the universal controller so that the two LED driving circuits are connected in parallel. When the input voltage is in a range from rectified 180 volt AC to rectified 265 volt AC, the first switch is turned off and the second switch is turned on to connect the LED segments of the LED unit in the first LED driving circuit in series with the second LED driving circuit.

In a first preferred embodiment, the universal controller sends a current setting signal to control the current of the current source of the first LED driving circuit according to the variation in the input voltage. In a modified version of the first preferred embodiment, a current sensing signal is fed back to the universal controller from the current source of the second LED driving circuit and the universal controller controls the current of the current source of the first LED driving circuit according to the current sensing signal.

In a second preferred embodiment of the present invention, the two LED driving circuits share a common current source instead of each having its own current source. The two LED driving circuits and two switches are connected in the same way as in the first preferred embodiments described above. However, in each LED driving circuit, the negative end of the last LED segment is connected in series with a voltage controlled current limiting device which is connected to the shared common current source.

In the second preferred embodiment, in addition to controlling the two switches to connect the two LED driving circuits in parallel or to connect the LED segments of the LED unit in the first LED driving circuit in series with the second LED driving circuit, the universal controller sends two separate voltage control signals to respectively control the two voltage controlled current limiting devices connected to the shared common current source and a current setting signal to control the current flowing through the shared common current source.

BRIEF DESCRIPTION OF THE DRAWINGS

The present invention will be apparent to those skilled in the art by reading the following detailed description of preferred embodiments thereof, with reference to the attached drawings, in which:

FIG. 6 shows another example of how the bypass switches are controlled by the LED controller according to the input voltage applied to the LED unit for the LED driving circuits shown in FIG. 4.

DETAILED DESCRIPTION OF THE PREFERRED EMBODIMENT

Figure 1:
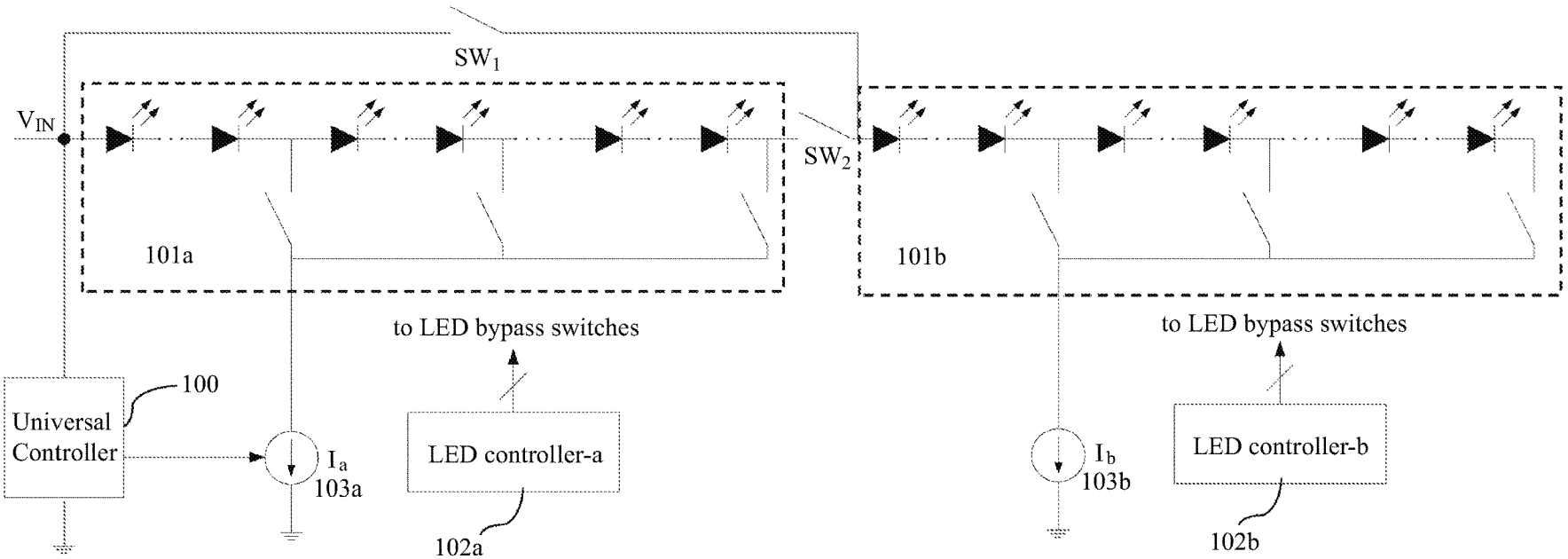
FIG. 1 shows a block diagram of an apparatus for driving LEDs using high voltage according to a first preferred embodiment of the present invention.

The accompanying drawings are included to provide a further understanding of the invention, and are incorporated in and constitute a part of this specification. The drawing illustrates embodiments of the invention and, together with the description, serves to explain the principles of the invention.

FIG. 1 shows a block diagram of an apparatus for driving LEDs using high voltage according to a first preferred embodiment of the present invention. In the embodiment, the apparatus comprises two LED driving circuits and two switches SW1 and SW2 controlled by a universal controller 100. The LED driving circuit shown on the left side of FIG. 1 includes an LED unit 101*a* connected with a current source 103*a*. The LED driving circuit shown on the right side of FIG. 1 includes an LED unit 101*b* connected with a current source 103*b*.

The universal controller 100 controls how the two switches SW1 and SW2 are turned on or turned off to connect the two LED driving circuits according to the input voltage $V_{IN}$. As shown in FIG. 1, each LED unit comprises a plurality of LEDs divided into a plurality of LED segments with each LED segment having an associated bypass switch. Except for the first and last LED segments, each LED segment has a positive end and a negative end connected respectively to the negative end of its preceding LED segment and the positive end of its following LED segment. In the first preferred embodiment, the current $I_a$ of the current source 103*a* in the LED driving circuit shown on the left side is also controlled by the universal controller 100.

As shown in FIG. 1, the bypass switch has one end connected to the negative end of its associated LED segment and the other end connected to a common node that is connected to the current source 103*a* or 103*b* in its respective LED driving circuit. An LED controller 102*a* or 102*b* controls the bypass switches in the respective LED driving circuit to bypass one or more LED segments in the corresponding LED unit by detecting one or more node voltages or branch currents of the LED driving circuit, which is equivalent to the variation in the input voltage applied to the corresponding LED unit.

In the present invention, the two driving circuits may comprise different or identical circuits. For example, LED unit 101*a* may be the same as or different from LED unit 101*b*. The number of segments in LED unit 101*a* may be the same or different from the number of segments in LED unit 101*b*. The number of LEDs in each segment may also be the same or different from the number of LEDs in other segments.

According to the present invention, when the input voltage $V_{IN}$ is in a range from rectified 90 volt AC to rectified 140 volt AC, for example, a rectified 110 volt AC voltage, switch SW1 is turned on and switch SW2 is turned off by the universal controller 100. At the same time, the current source 103*a* is also turned on. As a result, the two LED driving circuits are connected in parallel.

When the input voltage $V_{IN}$ is in a range from rectified 180 volt AC to rectified 265 volt AC, for example, a rectified 220 volt AC voltage, switch SW1 is turned off and switch SW2 is turned on so as to connect the LED segments of the LED unit 101*a* in series with the LED driving circuit shown on the right side of FIG. 1. At the same time, the universal controller 100 controls the current $I_a$ flowing through the current source 103*a* according to voltage variation in the input voltage $V_{IN}$.

The voltage variation in the input voltage $V_{IN}$ can be detected by directly sensing the input voltage $V_{IN}$, or detecting a related node voltage such as the voltage at one end of switch SW2, or a branch current of the LED driving circuits such as the current $I_b$ of the current source 103*b*. The switch SW2 may also be a passive switch such as a diode.

According to the present invention, when the input voltage $V_{IN}$ is not large enough to make the LED driving circuit shown on the right side of FIG. 1 conductive, the current source 103*a* is turned on. However, when the input voltage $V_{IN}$ is large enough to make the LED driving circuit shown on the right side of FIG. 1 conductive, the current source 103*a* is turned off.

The operating principles and examples of the universal controller 100 and current source 103*a* or 103*b* have been disclosed in detail in the related U.S. patent application Ser. No. 15/496,029, which is incorporated herewith by reference, and will not be repeated in this specification.

Figure 2:
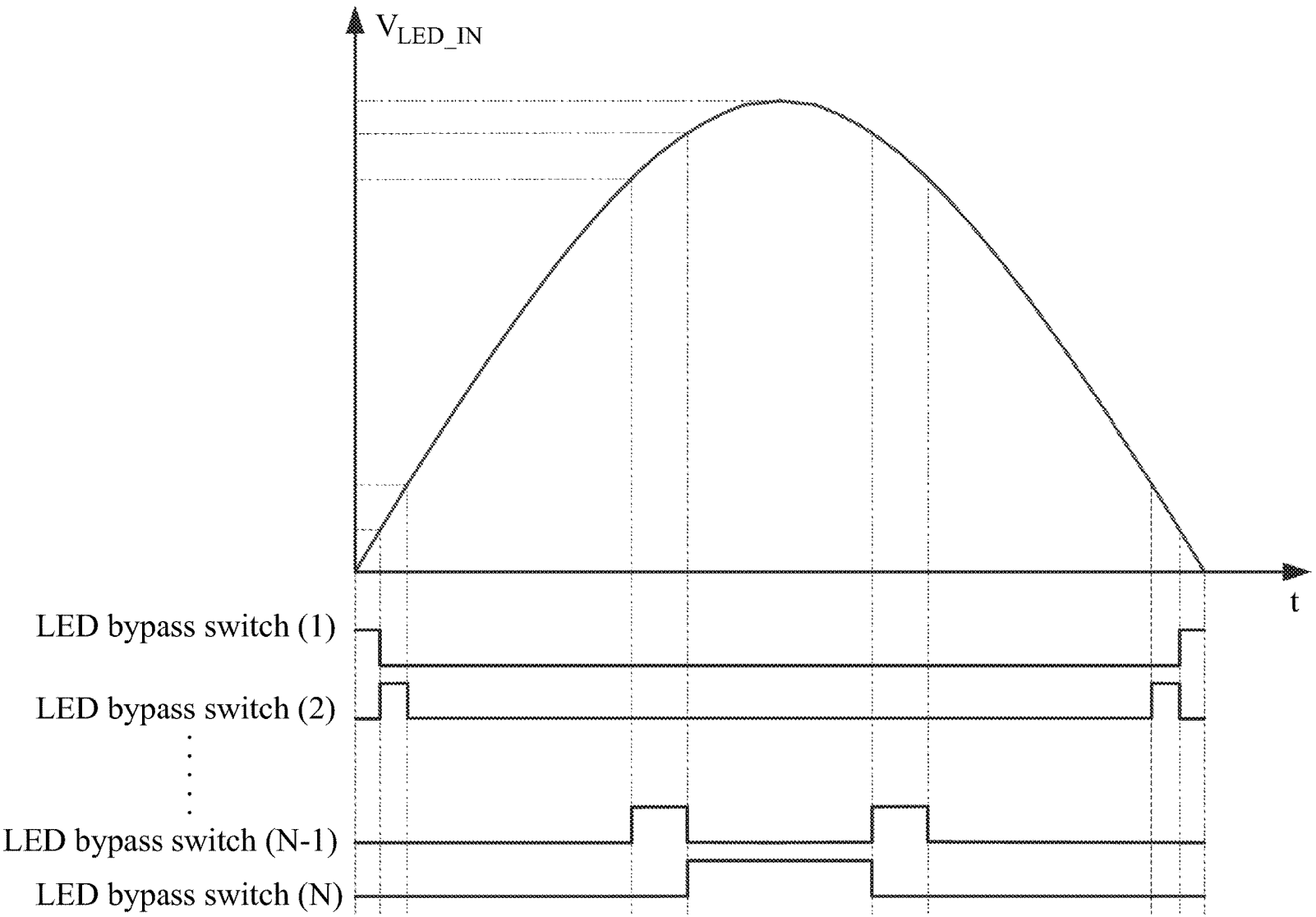
FIG. 2 shows an example of how the bypass switches are controlled by the LED controller according to the input voltage applied to the LED unit.

FIG. 2 shows an example of how the bypass switches are controlled by the LED controller 102*a* or 102*b* according to the input voltage applied to the LED unit. $V_{LED_IN}$ represents the input voltage applied to the LED unit of the bypass switches that are under control. The example shows that there are N bypass switches connected respectively with N associated LED segments in the LED unit. As $V_{LED_IN}$ increases, the bypass switches are sequentially turned on and off one by one in the order from the bypass switch associated with the first LED segment to the bypass switch associated with the last LED segment to increase the number of LED segments connected in series in the LED unit. As $V_{LED_IN}$ decreases, the bypass switches are also sequentially turned on and off one by one in a reverse order to decrease the number of LED segments connected in series in the LED unit.

Figure 3:
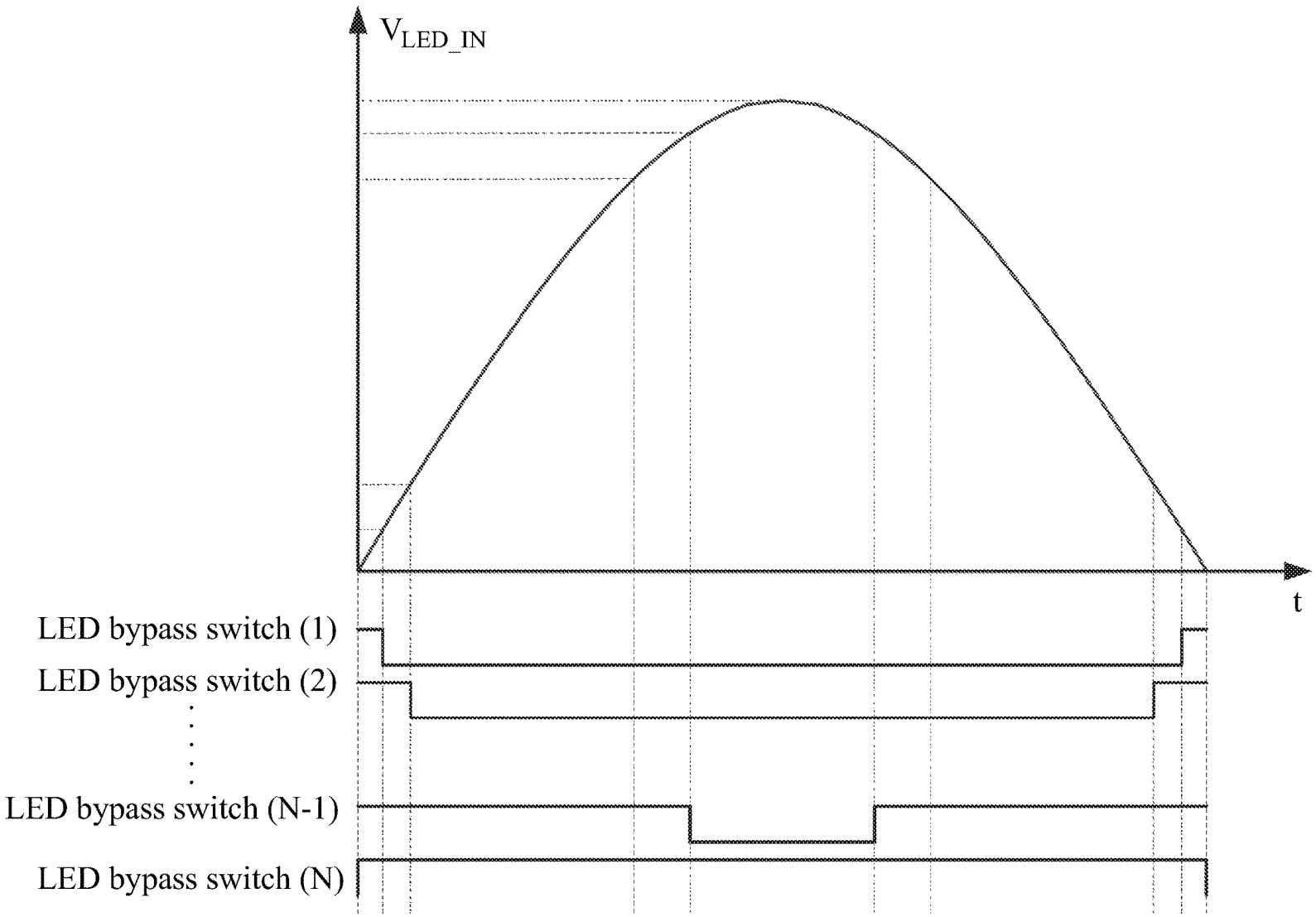
FIG. 3 shows another example of how the bypass switches are controlled by the LED controller according to the input voltage applied to the LED unit.

FIG. 3 shows another example of how the bypass switches are controlled by the LED controller 102*a* or 102*b* according to the input voltage applied to the LED unit $V_{LED_IN}$. In this example, all the bypass switches are turned on initially and then sequentially turned off one by one in the order from the bypass switch associated with the first LED segment to the bypass switch associated with the last LED segment as $V_{LED_IN}$ increases to increase the number of LED segments connected in series in the LED unit. As $V_{LED_IN}$ decreases, the bypass switches are sequentially turned on again one by one in a reverse order to decrease the number of LED segments connected in series in the LED unit. It should be noted that in this example the bypass switch associated with the last LED segment should always be turned on.

Figure 4:
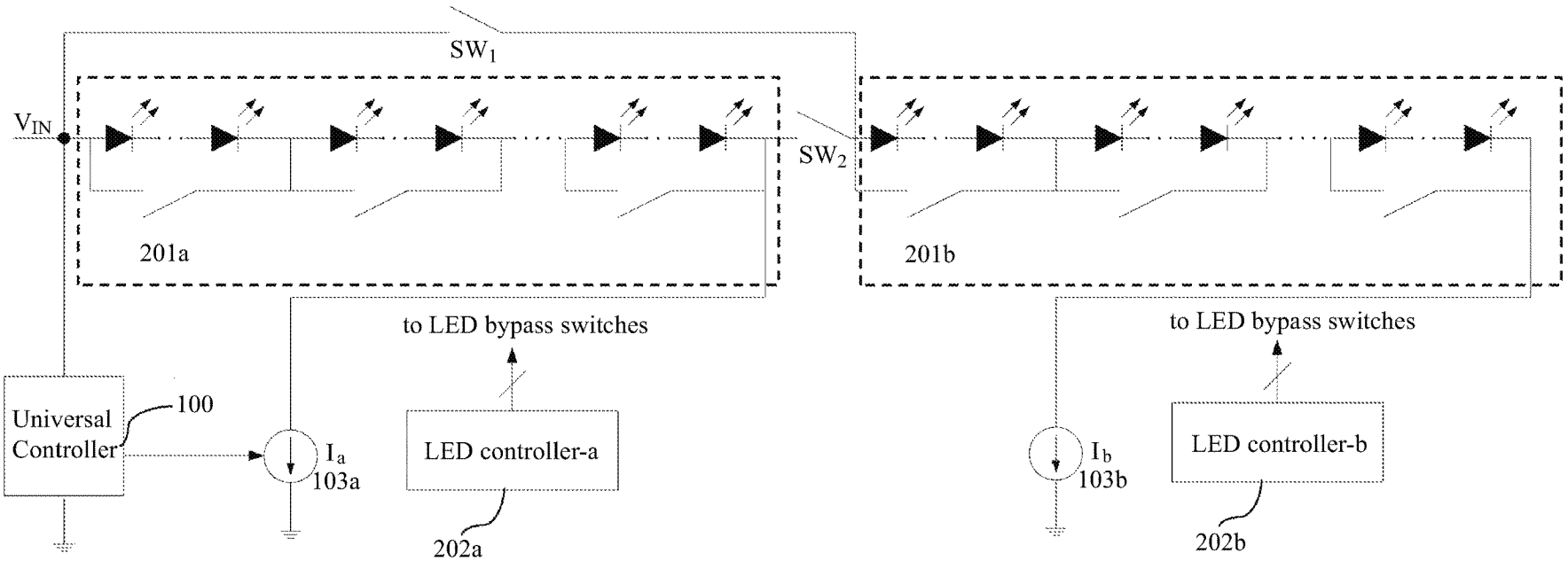
FIG. 4 shows the block diagram of an apparatus for driving LEDs using high voltage similar to FIG. 1 except that the two ends of each bypass switch are connected respectively with the positive and negative ends of its associated LED segment.

In accordance with the present invention, the two ends of each bypass switch may also be connected respectively with the positive and negative ends of its associated LED segment as shown in FIG. 4. As can be seen in FIG. 4, each LED segment in LED unit 201*a* or 201*b* has its associated bypass switch connected from the positive end to the negative end of the LED segment. As a result, each LED segment can be independently and selectively controlled by LED controller 202*a* or 202*b*.

Figure 5:
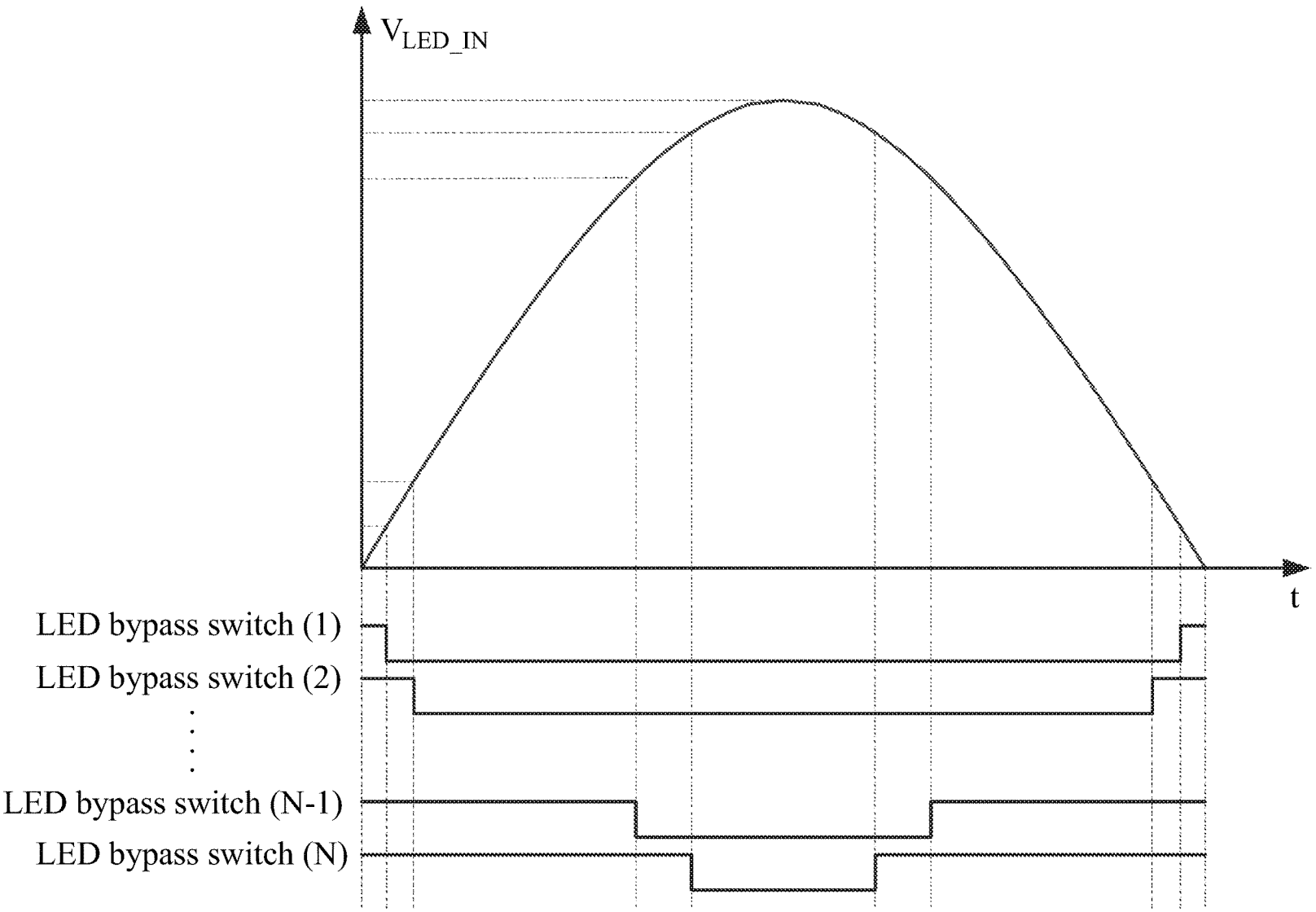
FIG. 5 shows an example of how the bypass switches are controlled by the LED controller according to the input voltage applied to the LED unit for the LED driving circuits shown in FIG. 4.

FIG. 5 shows an example of how the bypass switches are controlled by the LED controller 202*a* or 202*b* according to the input voltage applied to the LED unit for the LED driving circuits shown in FIG. 4. In this example, all the bypass switches are turned on initially and then sequentially turned off one by one in the order from the bypass switch associated with the first LED segment to the bypass switch associated with the last LED segment as $V_{LED_IN}$ increases to increase the number of LED segments connected in series in the LED unit. As $V_{LED_IN}$ decreases, the bypass switches are sequentially turned on again one by one in a reverse order to decrease the number of LED segments connected in series in the LED unit.

FIG. 6 shows another example of how the bypass switches are controlled by the LED controller 202*a* or 202*b* according to the input voltage applied to the LED unit for the LED driving circuits shown in FIG. 4. In this example, there are 15 LEDs in the LED unit and the 15 LEDs are divided into 4 LED segments. The numbers of LEDs in the 4 LED segments are configured as 1, 2, 4 and 8 respectively so that any number from 1 to 15 LEDs can be turned on by the LED controller to be connected in series in the LED unit.

As mentioned earlier, each LED segment can be selectively and independently controlled in the LED driving circuits shown in FIG. 4. In the example shown in FIG. 6, the bypass switches are not sequentially turned on or off. Instead, the bypass switches are turned on or off based on the appropriate number of LEDs that can be conductive under the voltage level of the input voltage applied to the LED unit $V_{LED_IN}$.

The table in FIG. 6 shows how the 4 bypass switches are turned on or off according to the LED input voltage levels. As can be seen in the table, when the LED input voltage $V_{LED_IN}$ is at level 1, only the bypass switch associated with LED segment 1 is turned off. Therefore, only one LED is conductive in the LED unit. When the LED input voltage $V_{LED_IN}$ is at level 2, only the bypass switch associated with LED segment 2 is turned off, and two LEDs are conductive in the LED unit because LED segment 2 has two LEDs.

As shown in the table of FIG. 6, it can be seen that the combinations as a result of the bypass switches being selectively turned on or off by the LED controller make 1, 2, 3, . . . , or 15 conductive LEDs in the LED unit as $V_{LED_IN}$ increases gradually at 15 different input voltage levels. Similarly, as $V_{LED_IN}$ decreases gradually at 15 different input voltage levels, the combinations as a result of the bypass switches being selectively turned on or off by the LED controller make 15, 14, 13, . . . , or 1 conductive LEDs in the LED unit.

Figure 7:
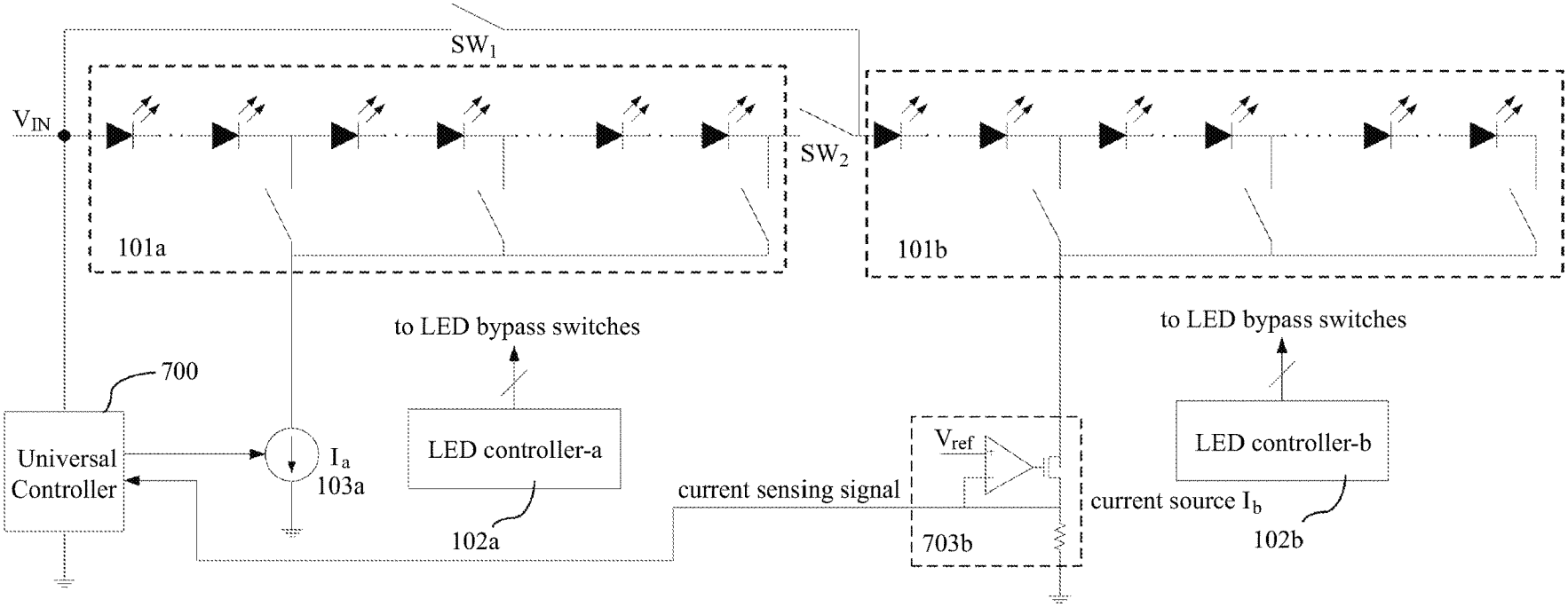
FIG. 7 shows a block diagram of an apparatus for driving LEDs using high voltage according to a modified version of the first preferred embodiment of the present invention shown in FIG. 1.

FIG. 7 shows a block diagram of an apparatus for driving LEDs using high voltage according to a modified version of the first preferred embodiment of the present invention shown in FIG. 1. In this embodiment, the apparatus also comprises two LED driving circuits and two switches SW1 and SW2 controlled by a universal controller 700. The LED driving circuit shown on the left side of FIG. 7 includes an LED unit 101*a* connected with a current source 103*a*. The LED driving circuit shown on the right side of FIG. 7 includes an LED unit 101*b* connected with a current source 703*b*.

As can be seen in FIG. 7, the current source 703*b* has a current sensing resistor connected to ground and the voltage level across the current sensing resistor is fed back to the universal controller 700 as a current sensing signal for the universal controller 700 to send a current setting signal to control the current source 103*a*.

As shown in FIG. 7, in addition to controlling the current source 103*a*, the universal controller 700 in this embodiment receives the current sensing signal from the current source 703*b* so that the current $I_a$ of the current source 103*a* can be determined by sensing the current $I_b$ flowing through the current source 703*b*. It can also be seen that each LED segment also has an associated bypass switch connecting from the negative end of the LED segment to a common node which is connected to the current source 103*a* or 703*b*.

Similar to the first preferred embodiment shown in FIG. 1, in this embodiment, when the input voltage $V_{IN}$ is in a range from rectified 90 volt AC to rectified 140 volt AC, for example, a rectified 110 volt AC voltage, switch SW1 is turned on and switch SW2 is turned off by the universal controller 700. At the same time, the current source 103*a* is also turned on. As a result, the two LED driving circuits are connected in parallel.

When the input voltage $V_{IN}$ is in a range from rectified 180 volt AC to rectified 265 volt AC, for example, a rectified 220 volt AC voltage, switch SW1 is turned off and switch SW2 is turned on so as to connect the LED segments of the LED unit 101*a* in series with the LED driving circuit shown on the right side of FIG. 7. At the same time, the universal controller 700 controls the current $I_a$ flowing through the current source 103*a* according to the current sensing signal sent from current source 703*b*.

The operating principles and examples of the universal controller 700 and current source 103*a* or 703*b* have been disclosed in detail in the related U.S. patent application Ser. No. 15/496,029, which is incorporated herewith by reference, and will not be repeated in this specification.

Figure 8:
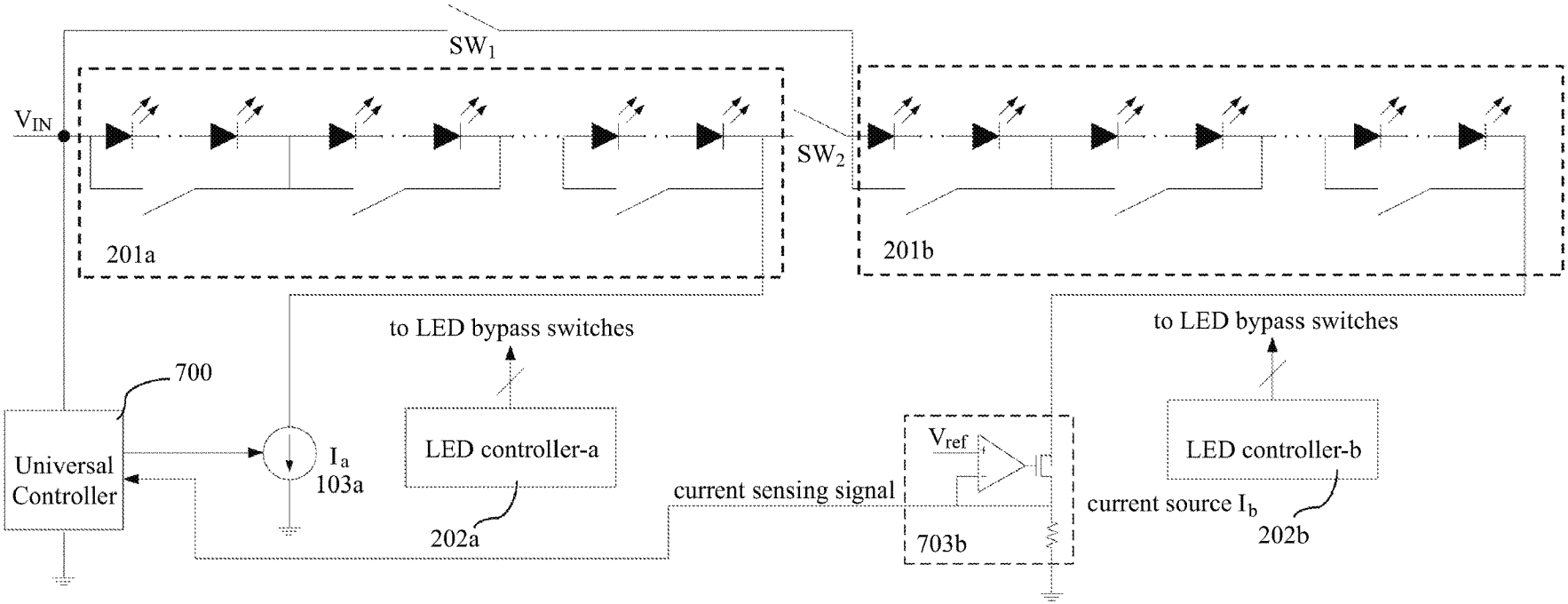
FIG. 8 shows the block diagram of an apparatus for driving LEDs using high voltage similar to FIG. 7 except that the two ends of each bypass switch are connected respectively with the positive and negative ends of its associated LED segment.

FIG. 8 shows a block diagram of the apparatus for driving LEDs using high voltage similar to the modified version of the first preferred embodiment shown in FIG. 7. However, in the two LED driving circuits of the apparatus of this embodiment, the two ends of each bypass switch in LED unit 201*a* or 201*b* are connected respectively with the positive and negative ends of its associated LED segment as shown in FIG. 8. Each LED segment can be selectively and independently controlled by LED controller 202*a* or 202*b*.

In the modified versions of the first preferred embodiment shown in FIGS. 7 and 8, how the bypass switches in each LED unit are controlled by their corresponding LED controllers according to the input voltage applied to the LED unit $V_{LED_IN}$ is similar to the first preferred embodiment shown in FIGS. 1 and 4. The principles and examples shown in FIGS. 2-3 and 5-6 and described earlier also apply to the modified versions of the first preferred embodiment.

Figure 9:
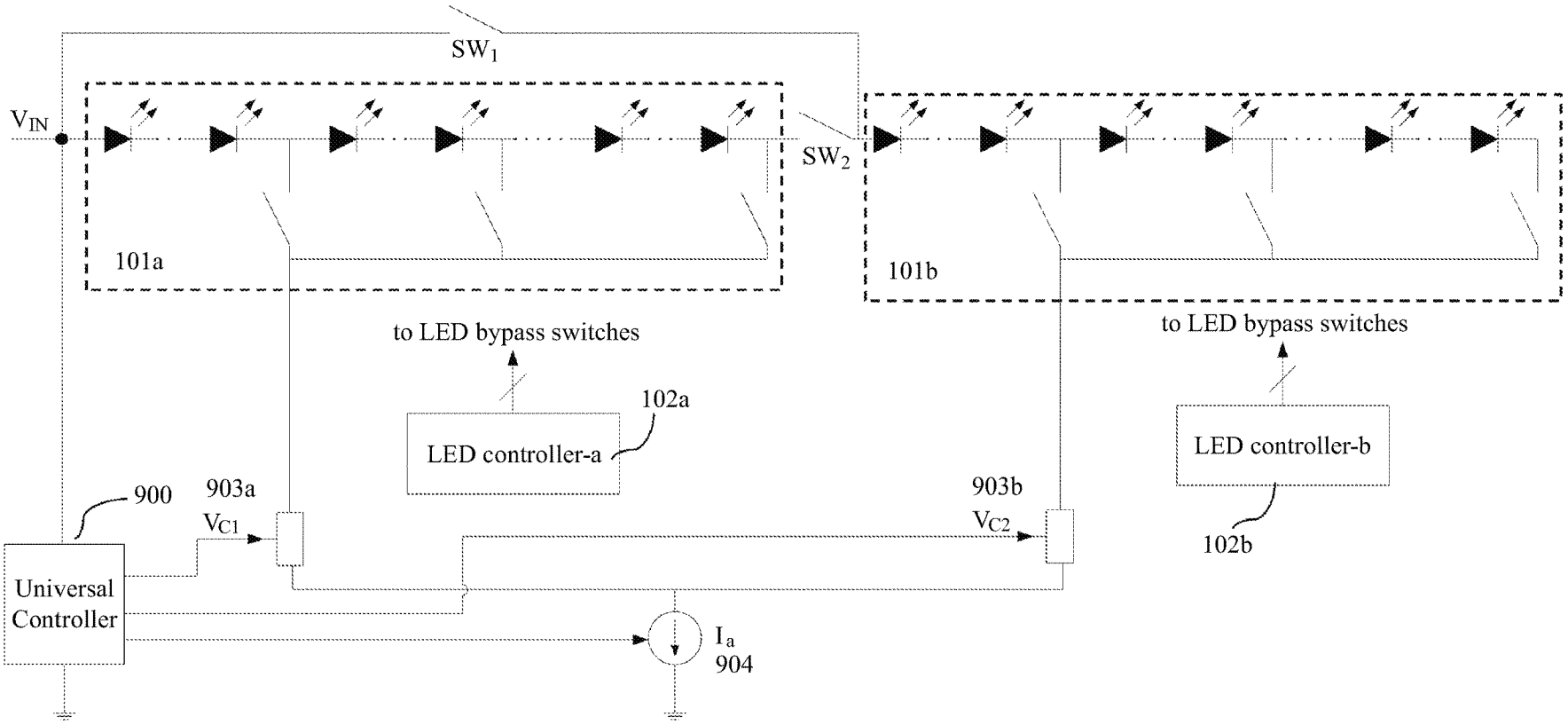
FIG. 9 shows a block diagram of an apparatus for driving LEDs using high voltage according to a second preferred embodiment of the present invention.

FIG. 9 shows a block diagram of an apparatus for driving LEDs using high voltage according to a second preferred embodiment of the present invention. In the embodiment, the apparatus comprises two LED driving circuits and two switches SW1 and SW2 controlled by a universal controller 900. The LED driving circuit shown on the left side of FIG. 9 includes an LED unit 101*a* connected with a voltage controlled current limiting device 903*a*. The LED driving circuit shown on the right side of FIG. 9 includes an LED unit 101*b* connected with a voltage controlled current limiting device 903*b*. A current source 904 connects both voltage controlled current limiting devices 903*a* and 903*b* to ground.

In this embodiment, the universal controller 900 controls the two switches SW1 and SW2, the two voltage controlled current limiting devices 903*a* and 903*b*, and the current source 904. $V_{C1}$ and $V_{C2}$ are control voltages for the two voltage controlled current limiting devices 903*a* and 903*b* respectively.

Similar to the first preferred embodiments, in this embodiment, when the input voltage $V_{IN}$ is in a range from rectified 90 volt AC to rectified 140 volt AC, for example, a rectified 110 volt AC voltage, switch SW1 is turned on and switch SW2 is turned off by the universal controller 900. The two control voltages for the two voltage controlled current limiting devices 903*a* and 903*b* are set identical.

When the input voltage $V_{IN}$ is in a range from rectified 180 volt AC to rectified 265 volt AC, for example, a rectified 220 volt AC voltage, switch SW1 is turned off and switch SW2 is turned on so as to connect the LED segments of the LED unit 101*a* in series with the LED driving circuit shown on the right side of FIG. 9. The control voltage of the voltage controlled current limiting device 903*b* of the second LED driving circuit is set greater than or equal to the control voltage of the voltage controlled current limiting device 903*a* of the first LED driving circuit.

The operating principles and examples of the universal controller 900, the two voltage controlled current limiting devices 903*a* and 903*b*, and current source 904 have been disclosed in detail in the related U.S. patent application Ser. No. 15/496,029, which is incorporated herewith by reference, and will not be repeated in this specification.

Figure 10:
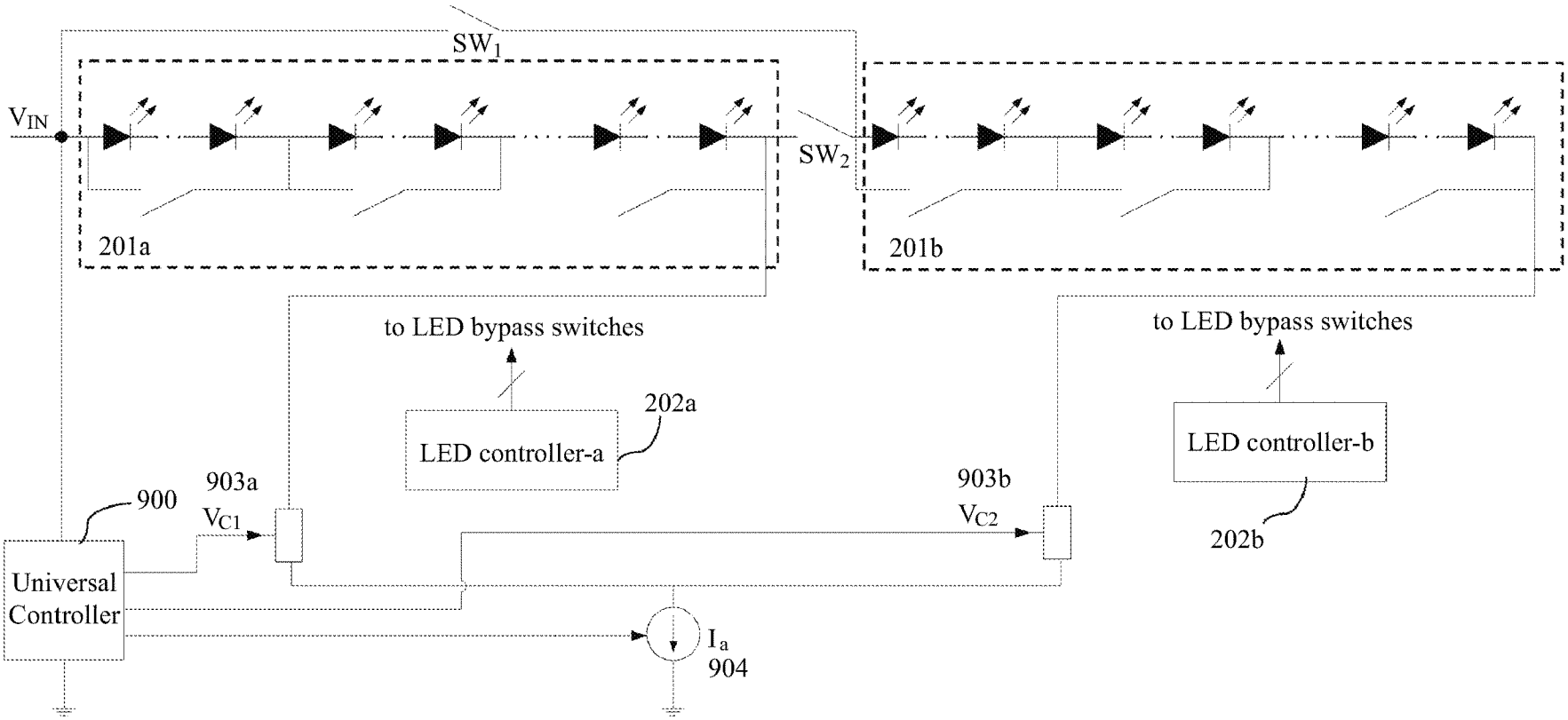
FIG. 10 shows the block diagram of an apparatus for driving LEDs using high voltage similar to FIG. 9 except that the two ends of each bypass switch are connected respectively with the positive and negative ends of its associated LED segment.

FIG. 10 shows a block diagram of the apparatus for driving LEDs using high voltage similar to the second preferred embodiment shown in FIG. 9. In the two LED driving circuits of the apparatus of this embodiment, however, the two ends of each bypass switch in LED unit 201*a* or 201*b* are connected respectively with the positive and negative ends of its associated LED segment as shown in FIG. 10. Each LED segment can be selectively and independently controlled by LED controller 202*a* or 202*b*.

In the second preferred embodiment shown in FIGS. 9 and 10, how the bypass switches in each LED unit are controlled by their corresponding LED controller according to the input voltage applied to the LED unit $V_{LED_IN}$ is also similar to the first embodiment shown in FIGS. 1 and 4. The principles and examples shown in FIGS. 2-3 and 5-6 and described earlier also apply to the second preferred embodiment.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An apparatus for driving a plurality of LEDs, comprising:

first and second LED driving circuits, each LED driving circuit including:

an LED unit having a plurality of LEDs divided into a plurality of LED segments connected in series including a leading LED segment and a trailing LED segment, each of said plurality LED segments having a positive end and a negative end;

a plurality of bypass switches, each of said plurality of bypass switches being associated with one of said plurality of LED segments, and having one end connected to the negative end of the associated LED segment and the other end connected to a common node;

an LED controller controlling said plurality of bypass switches; and a voltage controlled current limiting device having a first terminal connected to said common node, a second terminal connected to a control voltage, and a third terminal;

a first switching device having a first end connected to the positive end of the leading LED segment of said first LED driving circuit, and a second end connected to the positive end of the leading LED segment of said second LED driving circuit;

a second switching device having a first end connected to the negative end of the trailing LED segment of said first LED driving circuit, and a second end connected to the positive end of the leading LED segment of said second LED driving circuit;

a current source having a first end connected to the third terminals of the voltage controlled current limiting devices of said first and second LED driving circuits and a second end connected to ground;

a universal controller controlling said first and second switching devices and said current source, and providing the control voltages of the voltage controlled current limiting devices of said first and second LED driving circuits; and an input voltage connected to the positive end of the leading LED segment of said first LED driving circuit and said universal controller;

wherein said first switching device is turned on, said second switching device is turned off, and the two control voltages are set identical when said input voltage is between rectified 90 volt AC to rectified 140 volt AC, and said first switching device is turned off, said second switching device is turned on and the control voltage of the voltage controlled current limiting device of said second LED driving circuit is set greater than or equal to the control voltage of the voltage controlled current limiting device of said first LED driving circuit when said input voltage is between rectified 180 volt AC to rectified 265 volt AC.

2. The apparatus as claimed in claim 1, wherein said second switching device is a diode.

3. The apparatus as claimed in claim 1, wherein the plurality of bypass switches in each LED driving circuit are sequentially turned on and off by the LED controller one by one in an order from the bypass switch associated with the leading LED segment to the bypass switch associated with the trailing LED segment as the input voltage applied to said LED unit increases, and the plurality of bypass switches are sequentially turned on and off one by one in a reverse order from the bypass switch associated with the trailing LED segment to the bypass switch associated with the leading LED segment as the input voltage applied to said LED unit decreases.

4. The apparatus as claimed in claim 1, wherein said plurality of bypass switches in each LED driving circuit are initially all turned on and then sequentially turned off by the LED controller one by one in an order from the bypass switch associated with the leading LED segment to the bypass switch associated with the LED segment before the trailing LED segment as the input voltage applied to said LED unit increases, and the plurality of bypass switches are sequentially turned on one by one in a reverse order from the bypass switch associated with the LED segment before the trailing LED segment to the bypass switch associated with the leading LED segment as the input voltage applied to said LED unit decreases.

5. An apparatus for driving a plurality of LEDs, comprising:

first and second LED driving circuits, each LED driving circuit including:

an LED unit having a plurality of LEDs divided into a plurality of LED segments connected in series including a leading LED segment and a trailing LED segment, each of said plurality LED segments having a positive end and a negative end;

a plurality of bypass switches, each of said plurality of bypass switches being associated with one of said plurality of LED segments, and having one end connected to the positive end of the associated LED segment and the other end connected to the negative end of the associated LED segment;

an LED controller controlling said plurality of bypass switches; and a voltage controlled current limiting device having a first terminal connected to the negative end of the trailing LED segment, a second terminal connected to a control voltage, and a third terminal;

a first switching device having a first end connected to the positive end of the leading LED segment of said first LED driving circuit, and a second end connected to the positive end of the leading LED segment of said second LED driving circuit;

a second switching device having a first end connected to the negative end of the trailing LED segment of said first LED driving circuit, and a second end connected to the positive end of the leading LED segment of said second LED driving circuit;

a current source having a first end connected to the third terminals of the voltage controlled current limiting devices of said first and second LED driving circuits and a second end connected to ground;

a universal controller controlling said first and second switching devices and said current source, and providing the control voltages of the voltage controlled current limiting devices of said first and second LED driving circuits; and an input voltage connected to the positive end of the leading LED segment of said first LED driving circuit and said universal controller;

wherein said first switching device is turned on, said second switching device is turned off, and the two control voltages are set identical when said input voltage is between rectified 90 volt AC to rectified 140 volt AC, and said first switching device is turned off, said second switching device is turned on and the control voltage of the voltage controlled current limiting device of said second LED driving circuit is set greater than or equal to the control voltage of the voltage controlled current limiting device of said first LED driving circuit when said input voltage is between rectified 180 volt AC to rectified 265 volt AC.

6. The apparatus as claimed in claim 5, wherein said second switching device is a diode.

7. The apparatus as claimed in claim 5, wherein the plurality of bypass switches in each LED driving circuit are initially all turned on and then sequentially turned off by the LED controller one by one in an order from the bypass switch associated with the leading LED segment to the bypass switch associated with the trailing LED segment as the input voltage applied to said LED unit increases, and the plurality of bypass switches are sequentially turned on in a reverse order from the bypass switch associated with the trailing LED segment to the bypass switch associated with the leading LED segment as the input voltage applied to said LED unit decreases.

8. The apparatus as claimed in claim 5, wherein the plurality of bypass switches in each LED driving circuit are turned on or off selectively rather than sequentially to connect increasing number of LEDs in series as the input voltage applied to said LED unit increases, and the plurality of bypass switches are turned on and off selectively rather than sequentially to connect decreasing number of LEDs in series as the input voltage applied to said LED unit decreases.

* * * * *